United States Patent [19]

Ribaudo

[11] Patent Number: 4,529,203

[45] Date of Patent: Jul. 16, 1985

[54] GOLF CLUB

[76] Inventor: Nicholas A. Ribaudo, 2867 Dueby St., Sarasota, Fla. 33581

[21] Appl. No.: 413,740

[22] Filed: Sep. 1, 1982

[51] Int. Cl.[3] ..... A63B 53/04

[52] U.S. Cl. ..... 273/173; 273/175

[58] Field of Search ..... 273/167 J, 167 D, 175, 273/183 D, 169, 168, 78, 173, 174

[56] References Cited

U.S. PATENT DOCUMENTS

| | | | |
|---|---|---|---|
| D. 57,980 | 5/1921 | Kraeuter | 273/175 |
| D. 90,924 | 10/1933 | Replogle | 273/167 J |
| 1,526,951 | 2/1925 | Beaumont | 273/175 X |

FOREIGN PATENT DOCUMENTS

| | | | |
|---|---|---|---|
| 606516 | 3/1926 | France | 273/167 J |
| 4301 | of 1912 | United Kingdom | 273/167 J |

*Primary Examiner*—George J. Marlo

*Attorney, Agent, or Firm*—Shlesinger Arkwright Garvey & Fado

[57] ABSTRACT

A facing for a golf club having a series of channel-shaped spaced apart slots, said slots having a width of approximately 0.080 inches; said slots having a depth of 0.020 inches; and the distance between each set of slots being approximately 0.080 inches is disclosed.

1 Claim, 6 Drawing Figures

GOLF CLUB

BACKGROUND OF THE INVENTION

This invention relates to a new and unique facing for a golf club. A set of golf clubs is comprised of a number of woods and a number of irons. This invention relates to a facing for both woods and irons.

Golf is a game played with a small round ball and a set of golf clubs. The golf ball is struck with one of the golf clubs and propelled a distance toward a desired spot. A certain spin is imparted to the golf ball due to the contact of the golf ball with the golf club. If the ball is not struck properly the spin imparted may cause the ball to slice or to hook to one side of the playing surface or the other. The elimination of this slice or hook has been sought, probably, since the invention of the game of golf many years ago. It is old art to create a pattern on the facing of a golf club. These patterns have not, however, eliminated the slice or the hook of the golf ball.

This invention relates to a new and unique method of eliminating the slice or the hook of the golf ball by creating a new and unique golf club facing.

OBJECTS OF THE INVENTION

It is the primary object of this invention to construct a golf club facing having a specific pattern so that the slice or the hook of the golf ball will be eliminated.

It is a further object of this invention to create a facing on a golf club so that the golf ball, after having been struck, will travel in the direction intended by the player.

It is an additional object of this invention to create a golf club facing which is durable and resistant to cuts, nicks, and scratches due to the deposition of a layer of hard chromium plating.

DESCRIPTION OF THE INVENTION

Figure 1A:
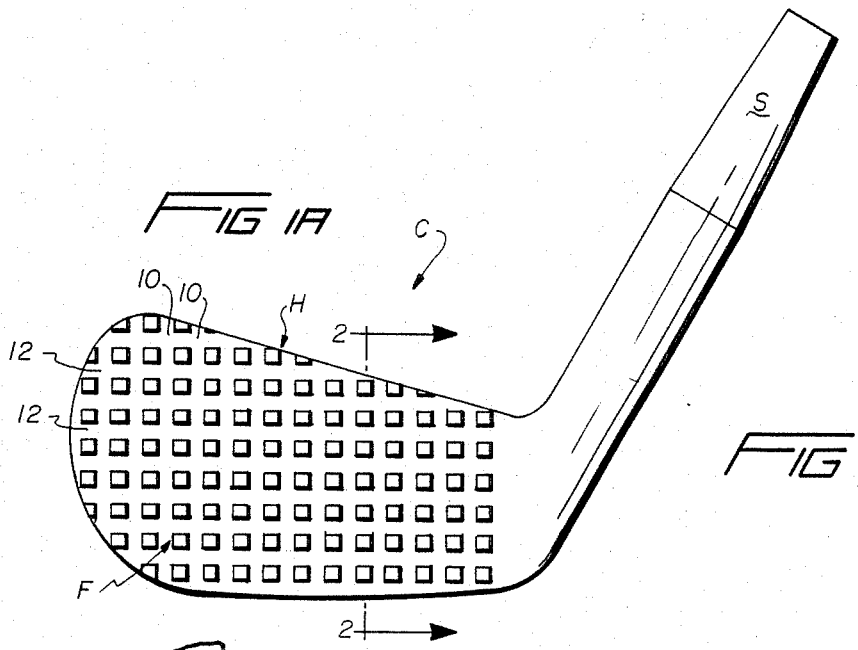
FIG. 1*a* is a front view of a golf club head showing a rectangular pattern on the facing.

Referring now to FIG. 1*a*, a golf club C having a shaft S and a head H is shown. The facing F is that part of the head H which contacts the golf ball (not shown).

Figure 2:
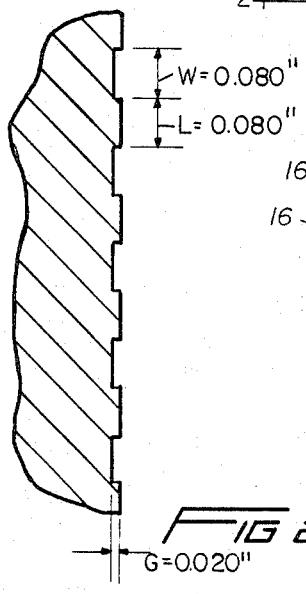
FIG. 2 is a cross-section through FIG. 1*a*.

The groove or slot G is shown in FIG. 2. This slot G has a depth D and a width W. The slot G is channel-shaped such that the width W is constant over the depth D. In this way the slot G resembles an open-ended box-type structure. The facing F contains a number of slots G machined, embossed, cut or engraved onto its face. In the preferred embodiment, the depth D of the slot G is about 0.020 inches and the width W is about 0.080 inches. The distance L between the successive slots is about 0.080 inches.

In FIG. 1*a* the face F of the head H is machined with two sets of slots G. The first of these sets is comprised of a number of parallel vertical slots 10 engraved, machined embossed or cut into the facing F of the head H. The second of the sets of slots is comprised of a number of horizontal parallel slots 12 engraved, machined, embossed or cut into the facing F of the head H. The intersection of these slots, 10 and 12, creates the appearance on the facing F of a number of rectangles.

Figure 1B:
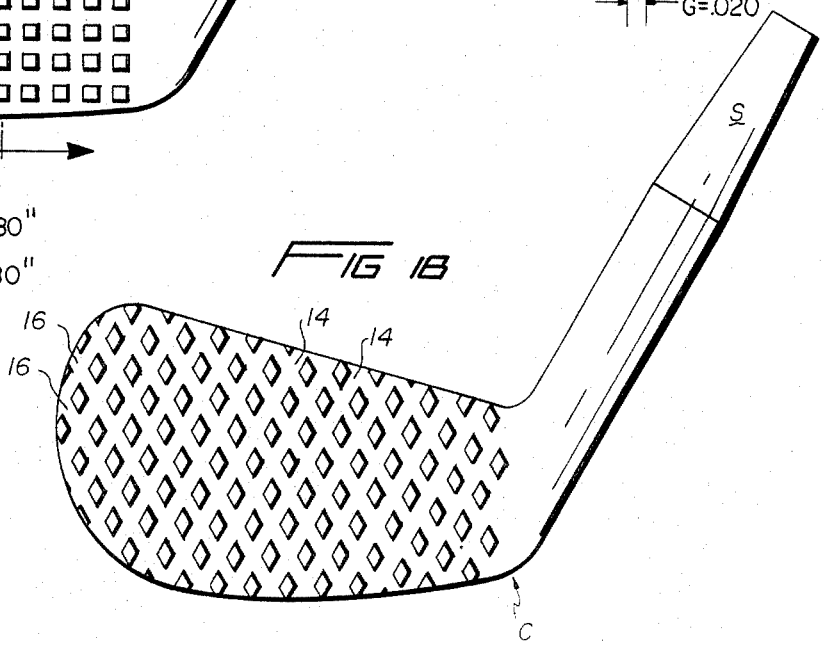
FIG. 1*b* is a front view of a golf club head showing a diamond shaped pattern on the facing.

FIG. 1*b* likewise shows two sets of parallel slots. The slots in FIG. 1*b* are not, however, horizontal and vertical in direction as in FIG. 1*a*. Slots 14 are parallel to each other. The slots 14 are at a diagonal on the face F in which the angle between a vertical line and the diagonal is a positive angle. The slots 16 are likewise parallel to each other and on a diagonal, but the angle with the diagonal is negative rather than positive relative to an x, y coordinate. When viewed from the front of the facing F, the intersections of the sets of slots, 14 and 16, resembles a number of diamonds on the facing F.

Figure 3A:
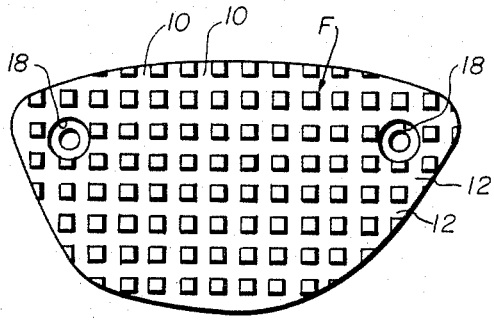
FIG. 3*a* is a front view of a detachable golf club facing having a rectangular pattern.
Figure 3B:
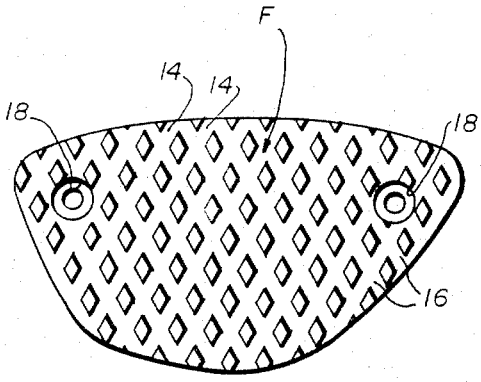
FIG. 3*b* is a front view of a detachable golf club facing having a diamond pattern.

FIGS. 3*a* and 3*b* show a detachable facing F of a golf club. In FIGS. 3*a* and 3*b* a number of holes 18 are drilled through the facing F in order to provide a means for fastening the facing F to the club C. FIG. 3*a* has a set of vertical and horizontal slots, creating a number of rectangles, similar to FIG. 1*a*. FIG. 3*b* has a set of diagonal slots, creating a number of diamond shapes as is shown in FIG. 1*b*.

Figure 4:
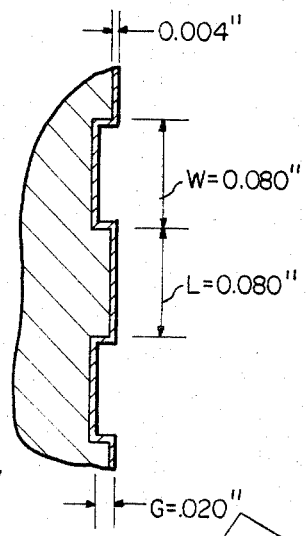
FIG. 4 is a cross-sectional view similar to that of FIG. 2 and disclosing a hard chrome coating.

In FIG. 4 the slots G and the facing F have a layer of hard chrome plating P deposited on them. This plating P is used to provide a hard, wear resistant, attractive surface for the facing F. This plating P is generally resistant to scratching, cutting, or nicking. In the preferred embodiment of the invention the plating P would have a thickness of approximately 0.004 inches. This plating P would be deposited on the facing F and the slots G after the slots G have been engraved, machined, embossed or cut into the club head H.

OPERATION OF THE INVENTION

The series of slots G engraved into the facing F are relatively wide when viewed relative to their depth D. A golf ball is a relatively hard, wound or solid, ball covered with a slightly resilient material. When the club C strikes the golf ball the golf ball flattens to some extent. As the golf ball is flattened the series of slots G mesh with and contact with the resilient covering of the golf ball. The facing F and the slots G have a combined surface area greater than that of the facing F alone. It is this greater surface area which is in gripping contact with the golf ball covering. This greater surface area yields a greater gripping contact with the resilient covering. This greater gripping contact results in better control over the spin imparted to the ball. By controlling the spin of the ball, the tendency to slice can be eliminated.

The hard chrome plating acts to preserve and protect the inter-connecting slots and to thereby lengthen the useful life of the golf clubs.

While this invention has been described as having a preferred design, it is understood that it is capable of further modification, uses and/or adaptations of the invention following in general the principal of the invention and including such departures from the present disclosure as come within known or customery practice in the art to which the invention pertains, and as may be applied to the central features hereinbefore set forth, and fall within the scope of the invention of the limits of the appended claims.

What I claim is:

1. A golf club including a striking face to control ball spin and resulting slicing and hooking by increasing the area of contact of the ball with the face when the ball is flattened during impact therewith, said face comprising:

(a) a first series of uniform channel-shaped spaced apart slots disposed in said face;

(b) a second series of uniform channel-shaped spaced apart parallel slots disposed in said face transverse of said first series;

(c) each of said slots of said first and second series having a width of 0.080 inches and a depth of 0.020 inches;

(d) said face having spacing between each of said slots of said first and second series of 0.080 inches;

(e) and a hard chrome plating layer disposed on said face and having a thickness of 0.004 inches;

(f) said spacing between each of said slots of said first and second series having a smooth surface.

* * * * *